United States Patent [19]

Sittig

[11] Patent Number: 4,926,060

[45] Date of Patent: May 15, 1990

[54] LAUNDRY RECEPTACLE CONSTRUCTION

[75] Inventor: Kenneth W. Sittig, Greenfield, Mass.

[73] Assignee: J. H. Smith Co., Inc., Greenfield, Mass.

[21] Appl. No.: 331,241

[22] Filed: Mar. 31, 1989

[51] Int. Cl.[5] ..... A63B 63/08; A45C 11/00

[52] U.S. Cl. ..... 273/400; 232/1 B; 248/100; 273/1.5 A

[58] Field of Search ..... 273/1.5 R, 1.5 A, 400, 273/401, 402; 232/1 B; 248/99, 95, 100; 211/86, 87, 88, 99, 113

[56] References Cited

U.S. PATENT DOCUMENTS 1,508,147 9/1924 Vinal ..... 273/400

3,244,420 4/1966 Poynter ..... 273/402

3,814,359 6/1974 Powell ..... 273/400 X

*Primary Examiner*—William H. Grieb

*Attorney, Agent, or Firm*—Chapin, Neal & Dempsey

[57] ABSTRACT

A laundry receptacle includes a backboard and a basketball hoop removably secured thereto by a bracket. A laundry bag is affixed at its open end about the periphery of the hoop. The bracket is designed to permit quick attachment and removal of the hoop. The bracket includes a downwardly opening hook portion to engage the upper surface of the hoop and two arms to engage the underside of the hoop. Hooks disposed along the upper edge of the backboard are adapted to fit onto the upper edge of a door for supporting the backboard thereon.

6 Claims, 1 Drawing Sheet

LAUNDRY RECEPTACLE CONSTRUCTION

BACKGROUND OF THE INVENTION

A laundry receptacle comprises a backboard, hoop, a bag and a bracket; the bracket removably attaches the hoop to the backboard. A laundry bag of netting material is affixed at its open end about the periphery of the hoop. The laundry receptacle is similar in appearance to a basketball hoop such that children will be motivated to pick up their laundry induced by the challenge of tossing items of laundry through the hoop into the bag.

It is the principal object of this invention to provide a laundry receptacle which simulates a basketball net, hoop and backboard arrangement.

It is another object of this invention to provide an improved mounting bracket by which to attach securely a laundry bag supporting hoop to a backboard and yet permit quick removal of the hoop to empty the laundry from the bag.

The above and other objects and advantages of this invention will be more readily apparent from a reading of the following detailed description in conjunction with the accompanying drawing, in which.

Figure 1:
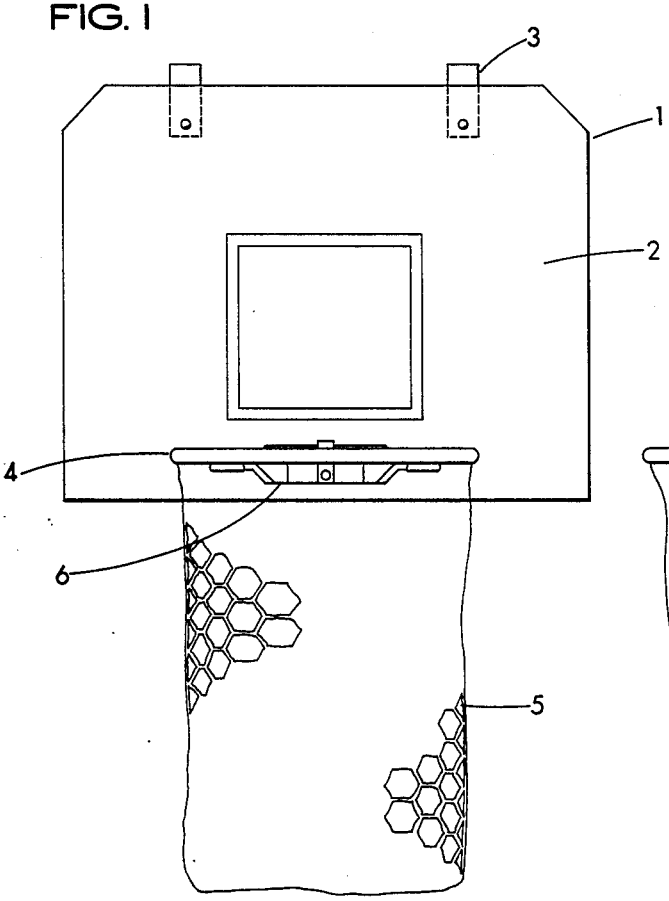
FIG. 1 is a front elevational view of a laundry receptacle construction of the type which embodies this invention.
Figure 2:
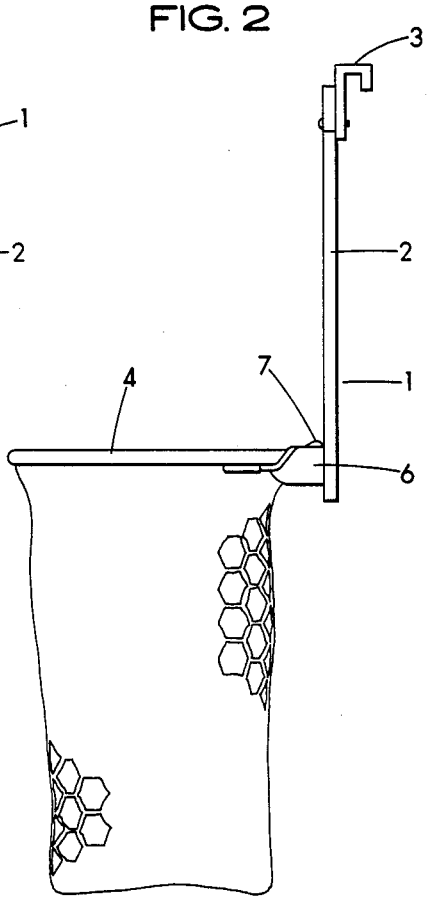
FIG. 2 is a side elevational view of the laundry receptacle construction of FIG. 1.

Referring now in detail to the drawings, FIGS. 1 and 2 show a laundry receptacle construction of the type embodying this invention. The laundry receptacle consists essentially of a laundry bag 5, hoop 4, bracket 6, backboard 2 and hooks 3. The open edge of bag 5 is attached to the periphery of a hoop 4 which, in turn, is removably attached to a backboard 2. The backboard, hoop and net are in the general shape of a basketball backboard, hoop and net arrangement. the backboard 2 is supported by a plurality of hooks 3 which can be hung over the top of a door or other convenient support members.

The bag 5 is similar in appearance to a standard basketball net, except bag 5 is closed at the bottom to retain the laundry within, and the bag is longer than an average basketball net so as to be able to hold a substantial volume of laundry. The hoop 4 is attached to the backboard 2 by bracket 6 which is rigidly affixed to backboard 2.

Figure 3:
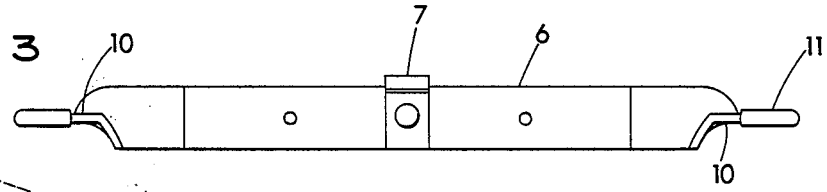
FIG. 3 is an elevational view in an enlarged scale of a mounting bracket of the type used in FIG. 1.
Figure 4:
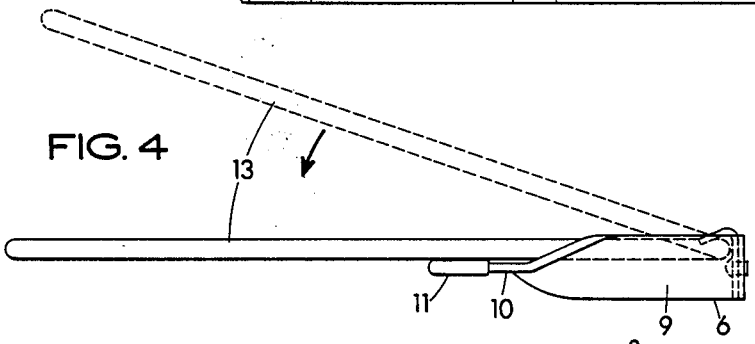
FIG. 4 is a side elevational view of the bracket of FIG. 3 shown with the hoop in different operative positions.
Figure 5:
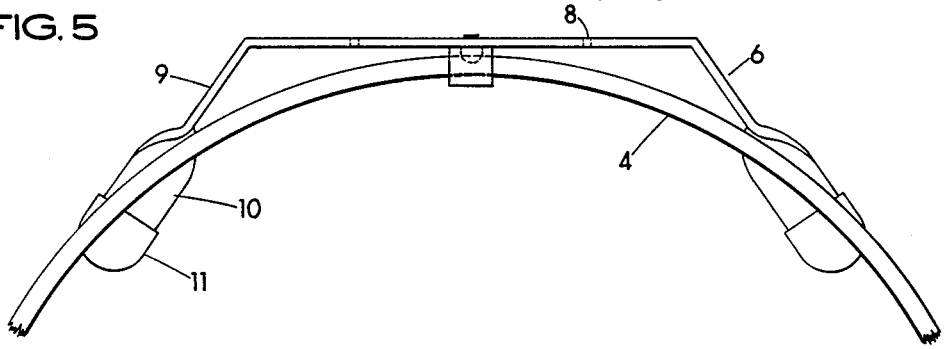
FIG. 5 is a top elevational view of the bracket of FIG. 3.

The bracket structure which is best shown in FIGS. 3, 4 and 5 is formed of a band of uniform width and thickness. The bracket may be metal, plastic or other suitable materials which includes a central portion 8, hook portion 7, two arm portions 9 and two hoop supporting strips 10. Plastic or rubber sheaths 11 cover the outer end portions of each hoop supporting member and serve to cushion the contact between the hoop and the bracket.

Figure 6:
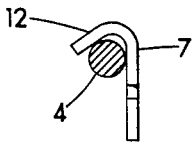
FIG. 6 is a partial side elevational view of the hook engaged with the hoop, as in FIG. 4.

The hook portion 7 of the bracket is curved, as shown in FIG. 6, to form a downwardly extending portion 12 which serves to vertically restrain the hoop. The highest point of the undersurface of the hook 7 is spaced above the upper surface of the hoop supporting members 10 a distance approximately equal to the diameter of the hoop 4. As a result, the hoop will be horizontally secured when it is in its assembled position.

When the hoop is being connected to the bracket, the hoop 4 is angled a distance 13 with respect to the horizontal axis as shown by the dotted lines in FIG. 4, such that the portion of the hoop adjacent the backboard may be placed under the downwardly extending portion 12 of the hook 7. The outer edge portion of the hoop 4 is then lowered into position such that the hoop is being upwardly supported by hoop supporting members 10. When the hoop is in position, it is also laterally constrained by arm portions 9 (see FIG. 5).

When bag 5 is filled with laundry, the distant portion of the hoop from bracket 6 is lifted into the raised position, shown by the dotted lines in FIG. 4. The hoop is then removed by simply lowering the position of the hoop away from the bent-over portion of hook 7.

Having thus described this invention, what is claimed is:

1. A laundry receptacle formed in the shape of a basketball hoop comprising a backboard, a circular hoop, a bag opened at one end with the open end being mounted around the periphery of the hoop, and a bracket comprising a hook portion and two hoop supporting members wherein the hook portion removably connects the hoop to the backboard and hoop supporting members are disposed to support the hoop on each side of the hook.

2. A laundry receptacle, as set forth in claim 1, in which the bracket further comprises an arm portion on each side of the hoop to restrict lateral displacement of the hoop.

3. A laundry receptacle, as set forth in claim 1, in which the bracket further includes a sheath which covers a portion of the hoop supporting member which cushions the contact between the hoop and the hoop supporting member.

4. A laundry receptacle, as set forth in claim 1, in which when the hoop is in position, the hook portion curves over the upper surface of the hoop to restrict motion of the hoop in an upward direction with respect to the backboard and in a direction away from the backboard.

5. A laundry receptacle, as set forth in claim 4, in which the highest point of the underside of the hook is above the hoop supporting member in the vertical direction a distance approximately equal to the width of the hoop, such that when the hoop is in position, the hoop will be in a horizontal plane.

6. A laundry receptacle, as set forth in claim 1, in which the bracket further comprises an arm portion on each side of the hoop fitted onto the bracket, the arm portions extending upwardly to restrict lateral displacement of the hoop.

* * * * *